US006670727B2

(12) United States Patent
Lee et al.

(10) Patent No.: US 6,670,727 B2
(45) Date of Patent: Dec. 30, 2003

(54) TIMED SWITCH

(75) Inventors: Danny Lee, Kaohsiung (TW); Jui-Pin Huang, Tainan (TW)

(73) Assignee: Shin Chin Industrial Co., Ltd., Tainan Hsien (TW)

( * ) Notice: Subject to any disclaimer, the term of this patent is extended or adjusted under 35 U.S.C. 154(b) by 216 days.

(21) Appl. No.: 10/021,241

(22) Filed: Dec. 19, 2001

(65) Prior Publication Data

US 2002/0185918 A1 Dec. 12, 2002

(30) Foreign Application Priority Data

Jun. 12, 2001 (TW) ..... 90209771 U

(51) Int. Cl.[7] ..... H01H 3/26

(52) U.S. Cl. ..... 307/140; 307/141.4; 200/339; 335/65

(58) Field of Search ..... 307/140, 141, 307/141.4; 200/35 R, 36, 37 R, 37 A, 38 R, 38 A, 38 F, 38 FA, 38 FB, 38 B, 38 BA, 38 C, 38 CA, 38 D, 38 DA, 38 DB, 38 DC, 38 E, 337, 339; 335/60–65

(56) References Cited

U.S. PATENT DOCUMENTS 3,683,301 A * 8/1972 Boley et al. ..... 335/59
3,693,119 A * 9/1972 Nakama et al. ..... 335/59
4,252,609 A * 2/1981 Kerst et al. ..... 376/134
4,307,303 A * 12/1981 Chiu ..... 307/141
4,426,639 A * 1/1984 Jessup ..... 340/528
4,721,034 A * 1/1988 Shimomura ..... 99/280
5,044,263 A * 9/1991 Birkert et al. ..... 99/327
5,304,782 A * 4/1994 McNair et al. ..... 219/518
5,584,380 A * 12/1996 Naitou ..... 200/315
6,103,981 A * 8/2000 Kremer ..... 200/296

* cited by examiner

*Primary Examiner*—Brian Sircus
*Assistant Examiner*—Sharon A. Polk
(74) *Attorney, Agent, or Firm*—Rosenberg, Klein & Lee

(57) ABSTRACT

A timed switch has a housing member, an output connecting leg connected to an appliance, and a circuit board including both a timing device and an electromagnet. The output connecting leg is electrically connected to the circuit board, and has a front end movable member disposed behind the front wall of the housing member. A control button is pivoted to the outer side of the front wall from a middle with an upper and a lower pushing protrusions passing through the front wall to abut an upper part and a lower part of the movable member respectively. A first, and a second input connecting legs are provided, which are connected to the power, and the second further to the circuit board. A power-on end of the button is pushed to make the upper part, and the lower part of the movable member to contact the first leg and the electromagnet respectively; thus, the appliance and the circuit board are energized, and the electromagnet attracts the lower part of the movable member thereto so as to make the upper part continue to contact the first leg to complete the circuit. At the same time, the timing device is actuated such that the appliance can be automatically turned off at a preselected time after it has been actuated.

2 Claims, 3 Drawing Sheets

TIMED SWITCH

BACKGROUND OF THE INVENTION

The present invention relates to a timed switch, and more particularly, to a timed switch, which can be fitted to all sorts of appliances, and can work together with other types of protective switches such as temperature switches to provide double protection so as to prevent accident from happening if the other types of protective switches fail to work properly.

Over the years, many protective switches have been developed to satisfy the need for a automatically turning off the appliances, such as timed switches which can turn off the appliances, after they have been actuated for a preselected time such that the appliances will not work too long and cause danger.

Other protective switches include temperature switches, which can automatically turn off the appliances when the same overheat. All of these protective switches are easy to use, and prevent many dangerous events from happening but people often neglect to maintain the protective switches while continuing to rely on them just because they are very convenient. An accident is likely to happen when the protective switches break down without anybody being aware of it.

Therefore, it would be a good idea to have a timed switch which can be easily fitted to an appliance and connected to the original protective switch of the appliance such that the appliance is provided with double protection.

SUMMARY OF THE INVENTION

Therefore, it is a main object of the present invention to provide a timed switch, which can be easily fitted to an appliance, and connected to other protective switches of the appliance to provide double protection. And, it is another object of the present invention to provide a timed switch, which is easy to use and doesn't have the drawbacks of conventional ones.

The timed switch of the present invention includes a housing member, first, second, and third connecting legs, a control button, and a circuit board.

The housing member has a front part and a rear part. The first connecting leg has a front end contacting portion disposed behind the front part, and have a rear end connecting portion sticking out from the rear part of the housing member for electrical connection with a power supply.

The circuit board includes an electromagnet and a timing device. The circuit board is received in the housing member, and is electrically connected to a second connecting leg having a rear end sticking out from the rear part of the housing member. The timing device can make the circuit of the circuit board become open at a preselected time after same has been energized.

The third leg has a connecting part having a rear end sticking out from the housing member for electrical connection with the input terminal of an appliance, and a vertical part disposed behind the front part of the housing member; the vertical part has an upper end, and a lower end disposed behind the contacting portion of the first leg, and in front of the electromagnet respectively. The third leg is further electrically connected to the circuit board.

The control button has a power-off upper end, and a power-on lower end, and is pivoted to the front part of the housing member at a middle with an upper, and a lower pushing protrusions passing through the front part to abut the upper, and the lower ends of the vertical part.

Thus, the appliance can be energized when said power-on end is pushed so as to make the lower end of the vertical part come into contact with the electromagnet plus make the upper end of the vertical part come into contact with the contacting portion of the first leg; the circuit board becomes complete for both the electromagnet, and the timing device to be actuated to attract the lower end of the vertical part thereto, and to automatically turn off the appliance at the preselected time respectively.

BRIEF DESCRIPTION OF THE DRAWINGS

The present invention will be better understood by reference to the accompanying drawings, wherein.

DETAILED DESCRIPTION OF THE PREFERRED EMBODIMENT

Figure 1:
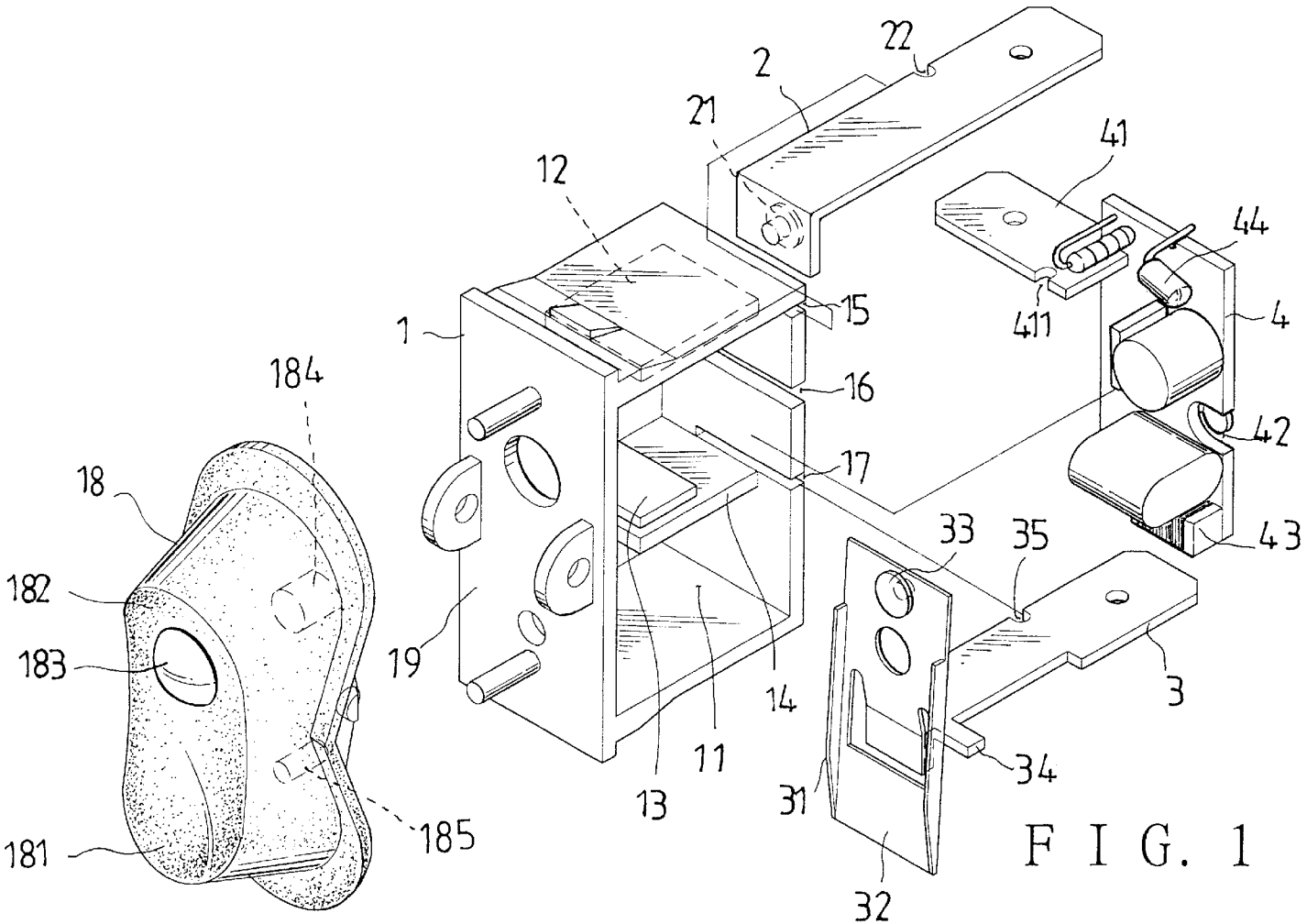
FIG. 1 is an exploded perspective view of the timed switch according to the present invention.
Figure 4:
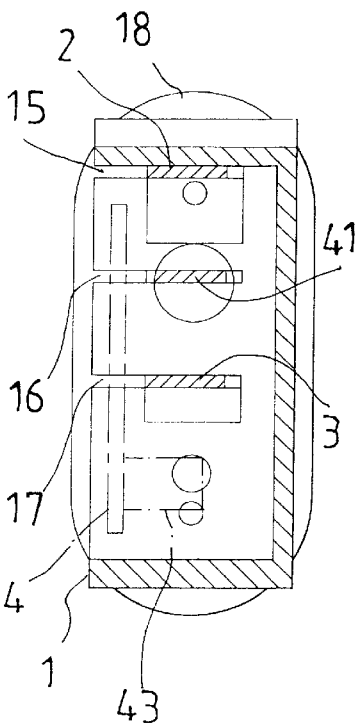
FIG. 4 is another timed switch according to the present invention.
Figure 3:
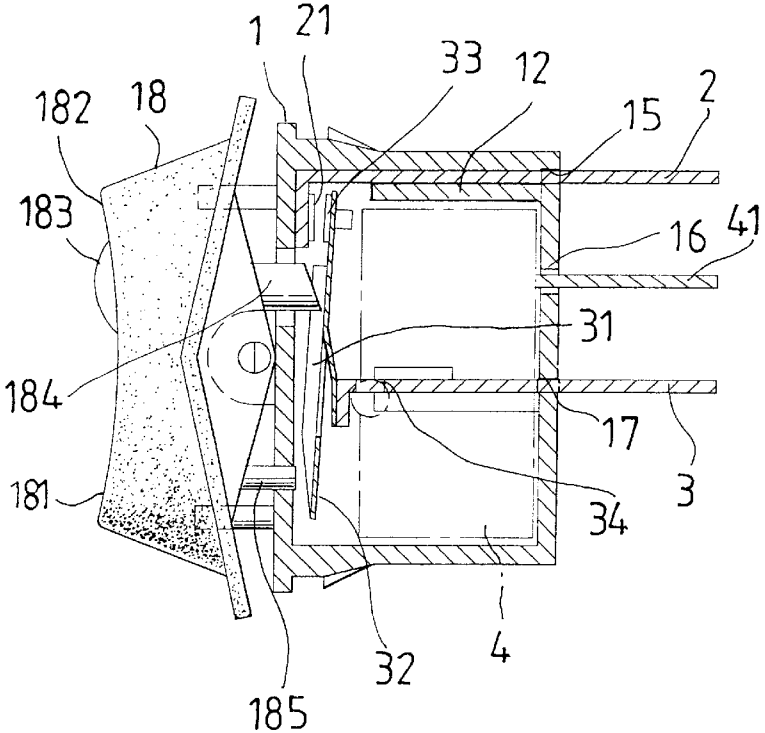
FIG. 3 is a cross-sectional view of the timed switch according to the present invention.
Figure 2:
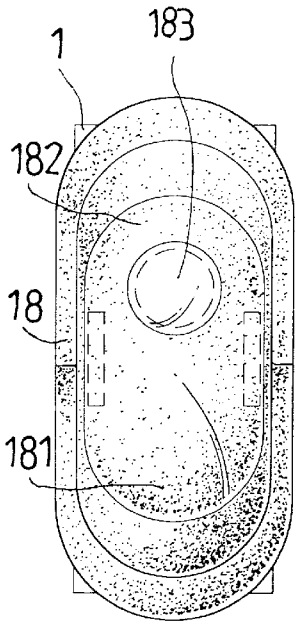
FIG. 2 is a front view of the timed switch according to the present invention.

Referring to FIG. 1, a timed switch of the present invention includes a housing member 1, a first metallic connecting leg 2, a control button 18, a circuit board 4, a second metallic connecting leg 41, and a third metallic connecting leg 3.

The housing member 1 has a front part 19, a rear part (not numbered) and a receiving room 11; the rear part is provided with a first elongated gap 15, a second elongated gap 16 and a third elongated gap 17. The housing member 1 further has a first separating board 12, a second separating board 13, and a third separating board 14 secured to the inner side thereof, the first separating board 12 is arranged below the top of the housing member 1 with a space in between; the second and the separating boards 13 and 14 are arranged such that the space in between is just opposite the third elongated gap 17. The front part 19 has an upper through hole communicating with a space defined by both the separating boards 12 and 13, and a lower through hole communicating with a space defined by both the third separating board 14 and the bottom of the housing member 1.

The first connecting leg 2 has a contacting portion 21 at the front thereof, and an engaging gap 22 at the middle part, and is inserted into the first elongated gap 15 with the engaging gap 22 closely mounted on the edge of the inner end of the first elongated gap 15 such that the contacting portion 21 faces the front part 19, and the rear end portion of first connecting sticks out from the rear part of the housing member for electrical connection to the power supply.

The third connecting leg 3 has a horizontal connecting part and a vertical part; the horizontal part has a connecting portion 34 at the front portion and an engaging gap 35 at the middle portion; the middle portion of the vertical part is pivoted to the front end of the horizontal part, and has a contacting portion 33 at the upper end, resilient strip portions 31 sticking frontward therefrom, and an attracted portion 32 at the lower end. The horizontal part of the third connecting leg 3 is inserted into the third elongated gap 17 as well as the space between the second and the third separating boards 13 and 14 with the engaging gap 35 closely mounted on the edge of the inner end of the gap 17 such that the vertical part faces the front part 19 of the housing member 1 in a substantially parallel orientation, and the rear end portion of the third connecting leg 3 sticks out from the rear part of the housing member 1 as an out put terminal. The resilient strips 31 abut the inner side of the front part 19 to keep the upper end contacting portion 33 away from the contacting portion 21 when the power-on end 181 is not pressed to actuate the circuit board 4.

The circuit board 4 has an indicating light 44, a gap 42 at the middle portion and an electromagnet 43 at the lower end. The second connecting leg 41 is fixed, and electrically connected, to the circuit board 4, and has an engaging gap 411. The circuit board 4 joined to the second connecting leg 41 is fitted into the housing member 1 with the engaging gap 411 of the second connecting leg 41 closely mounting on the edge of the inner end of the second elongated gap 16; a rear end portion of the second connecting leg 41 sticks out from the rear part of the housing member 1 for electrical connection with the power supply; the gap 42 is mounted around the connecting portion 34 of the third connecting leg 3 such that solder can be applied thereto to electrically connect both together; the electromagnet 43 faces, and is relatively close to, the attracted portion 32 of the third connecting leg 3. In addition, the circuit board 4 is provided with a timing device (not shown) such that it will be automatically disconnected from the power supply at a preselected time after it has been energized.

The control button 18 has the same size and specification as ordinary switches, and has a power-on end 181, a power-off end 182 on the outer side, and a first, and a second pushing protrusions 184, and 185 on the inner side, and has a transparent cover 183 mounted on a through hole formed thereon. The control button 18 is pivoted to a middle part of the front part 19 of the housing member 1 from a middle part thereof with the first, and the second pushing protrusions 184, and 185 passing through the upper, and the lower through holes of the front part 19 respectively to face the contacting portions 33, and the attracted portion 32 of the third connecting leg 3.

Figure 5:
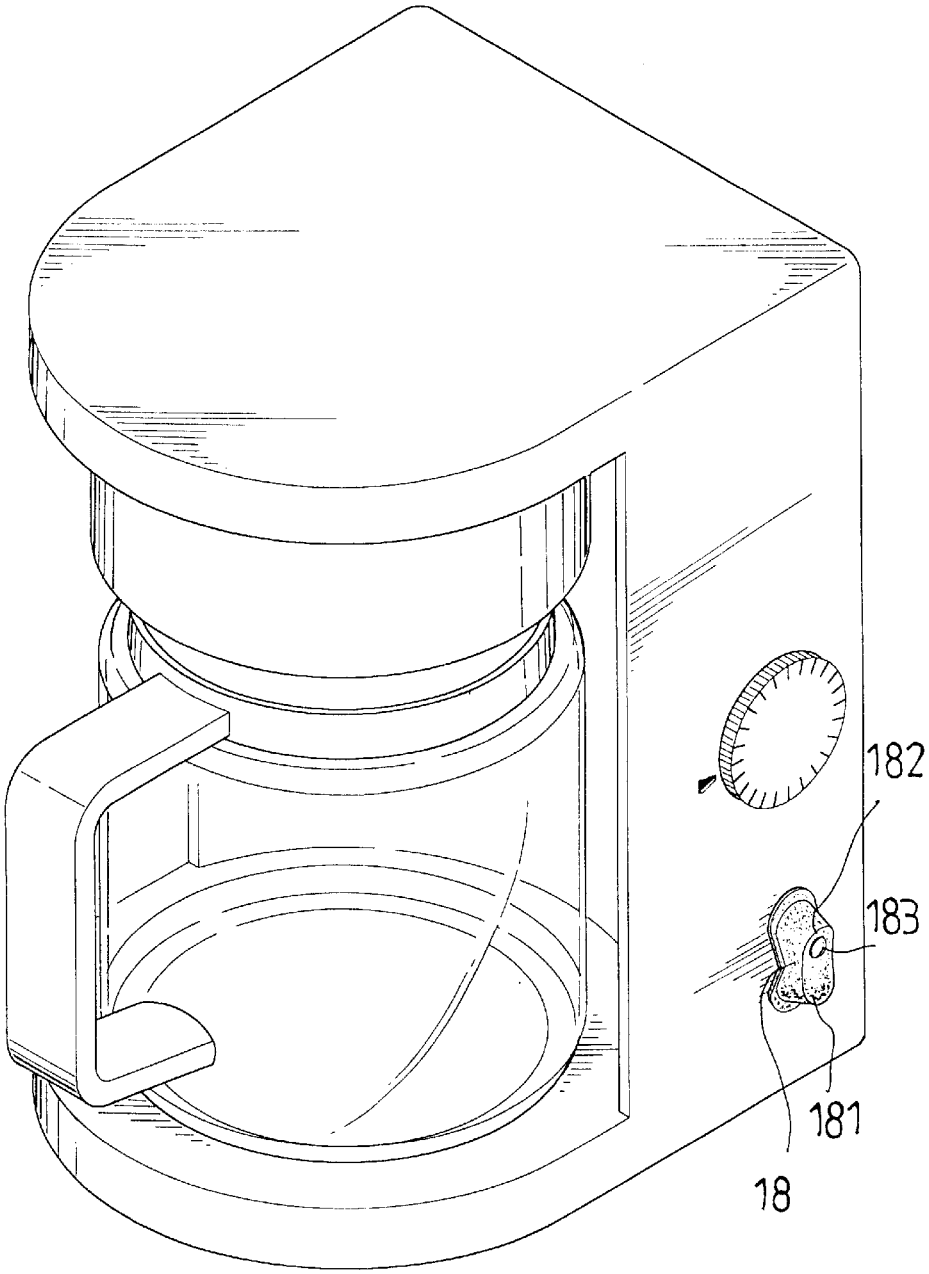
FIG. 5 is view of an appliance with the timed switch of the present invention.

Referring to FIG. 5, in using the timed switch after the same has been fitted to an appliance with the first and the second connecting legs 2 and 41 being electrically connected to the wires from the power supply, and the third connecting leg 3 to the input terminal of the appliance, the power-on end 181 of the control button 18 is pushed towards the front part 19 such that the second pushing protrusion 185 makes the attracted portion 32 of the third leg 3 move towards, and get into contact with, the electromagnet 43, and makes the upper end contacting portion 33 move towards, and get into contact with, the contacting portion 21 of the first connecting leg 2, thus completing the circuit of the circuit board 4 in other words, now electricity can travel through the circuit board 4 from the first and the second connecting legs 2 and 41 because the connecting portion 34 is already electrically connected to the circuit board 4. And, the electromagnet 43 is now energized to attract the attracted portion 32 of the third leg 3 so as to make the upper end contacting portion 33 of the third leg 3 continue to contact the contacting portion 21 of the first leg 2. Thus, electricity can travel through the third leg 3 to energize the appliance. The indicating light 44 also emit light through the transparent cover 183 as a sign. In addition, the timing device on the circuit boards 4 is also activated when the circuit board 4 is completed; thus, the flow of the electricity on the circuit board 4 can be automatically cut after preselected time for the timing device, and the electromagnet 43 can no longer attract the attracted portion 32, allowing the upper end contacting portion 33 of the flexible vertical part to be biased away from the contacting portion 21 of the first leg 2 by the resilient strip portions 31. Therefore, the appliance can be automatically turned off after it has been energized for the preselected time.

To turn off the appliance with the timed switch manually before it is automatically turned off at the preselected time, the power-off end 182 of the control button 18 is pushed so that the first pushing protrusion 184 makes the upper end contacting portion 33 of the third leg 3 separate from the contacting portion 21. Thus, the circuit of the circuit board 4 becomes open, and the electromagnet 43 can no longer attract the attracted portion 32, i.e. the attracted portion 32 no longer contacts the electromagnet 43 and the contacting portion 33 no longer contacts the contacting portion 21.

From of the above description, it can be easily understood that the time switch of the present invention has desirable features as follows:

1. The timed switched can be easily used by means of pushing the power-on end, and the power-off end of the control button to energize the appliance and at the same time actuate the timing device for automatically cutting same off at the preselected time, and to manually turn off the appliance respectively.
2. The timed switch can be fitted to appliances that are already equipped with protective switches such as temperature switches so as to provide the appliances with double protection.
3. The control button of the timed switch has the same size, and specification as ordinary switch; therefore it can be easily fitted to all sorts of appliances.

What is claimed is:

1. A timed switch, comprising a housing member having a front part and a rear part;

a first connecting leg having a contacting portion at a front end, and a connecting portion at a rear end; said first connecting leg being connected to said housing member with said front end contacting portion being disposed behind said front part of said housing member, and with said rear end connecting portion sticking out from said rear part of said housing member for electrical connection with a power supply;

a circuit board including an electromagnet and timing device;

said circuit board being received in said housing member with said electromagnet being disposed behind said front part; said circuit board being electrically connected to a second connecting leg having a rear end portion sticking out from said rear part of said housing member for electrical connection with said power supply; said timing device electrically disconnecting said circuit board from said power supply at a preselected time after same has been energized;

a third connecting leg including a connecting part and a flexible vertical part; said third leg being fitted to said housing member with a rear end portion of said connecting part sticking out for electrical connection with a power input terminal of an appliance; said vertical part being disposed behind said front part in substantially parallel orientation with an upper end contacting portion thereof being behind and away from said front end contacting portion of said first leg, and with a lower end attracted portion facing said electromagnet; said third leg being electrically connected to said circuit board;

a control button including a power-off upper end and a power-on lower end; said control button being pivoted to said front part of said housing member from a middle part thereof with an upper, and a lower pushing protrusions being passed through holes of said front part to abut said upper end contacting portion, and said lower end attracted portion of said vertical part respectively;

whereby said appliance is energized when said power-on end of said control button is pushed so as to make said attracted portion of said vertical part come into contact with said electromagnet plus make said upper end contacting portion come into contact with said front end contacting portion of said first leg, allowing said circuit board to become complete for both said electromagnet and said timing device to be actuated;

said electromagnet attracting said attracted portion thereto so as to make said upper end contacting portion continue to contact said front end contacting portion of said first leg for maintaining flow of electricity through said circuit board;

said appliance being capable of being cut from said power supply manually, and automatically by means of pushing said power-off end of said control button to make said upper end contacting portion separate from said first leg, and by means of said timing device capable of making said circuit board become open at said preselected time for said electromagnet to lose said attraction on said attracted portion respectively; said upper end contacting portion separating from said first leg due to separation of said attracted portion from said electromagnet.

2. The time switch as claimed is claim 1, wherein said vertical part of said third connecting leg has resilient strips sticking frontward therefrom to abut an inner side of said front part of said housing member; said resilient strips biasing said upper end rearwards to help same separate from said first leg contacting portion when said electromagnet loses said attraction on said attracted portion; said resilient strips keeping said upper end contacting portion of said vertical part away from said first leg contacting portion when said power-on end of said control button is not pushed to actuate said circuit board.

* * * * *